United States Patent [19]

Champeaux et al.

[11] Patent Number: 5,033,549

[45] Date of Patent: Jul. 23, 1991

[54] METHOD FOR PLACING A GRAVEL PACK IN AN OIL WELL WITH AN ELECTRIC WIRELINE

[75] Inventors: Glenn Champeaux, Broussard; James V. Carisella, New Orleans, both of La.

[73] Assignee: Perf-O-Log, Inc., Broussard, La.

[21] Appl. No.: 457,369

[22] Filed: Dec. 27, 1989

[51] Int. Cl.[5] ..... E21B 43/04

[52] U.S. Cl. ..... 166/278; 166/51; 166/228; 166/229; 166/235

[58] Field of Search ..... 166/278, 378, 380–382, 166/385, 51, 227, 228, 235, 236, 229

[56] References Cited

U.S. PATENT DOCUMENTS

| | | | |
|---|---|---|---|
| 2,452,654 | 11/1948 | Hayes et al. | 166/278 |
| 2,707,998 | 5/1955 | Baker et al. | 166/63 |
| 2,775,303 | 12/1956 | Abendroth et al. | 166/278 |
| 2,896,714 | 11/1956 | Killingsworth | 166/278 |
| 4,491,178 | 1/1985 | Terrell et al. | 166/285 |
| 4,682,657 | 7/1987 | Crawford | 166/77 |
| 4,790,381 | 12/1988 | Armell | 166/241 |
| 4,844,166 | 7/1989 | Going, III et al. | 166/372 |
| 4,860,831 | 8/1989 | Caillier | 166/236 |

*Primary Examiner*—Ramon S. Britts
*Assistant Examiner*—Roger J. Schoeppel
*Attorney, Agent, or Firm*—Pravel, Gambrell, Hewitt, Kimball & Krieger

[57] ABSTRACT

A method for setting a gravel pack in an oil well through tubing situation includes the steps of running a tool body into the well using an electric wireline. The tool body is precisely positioned relative to the surrounding casing, and radially extending members attached to the tool are used to center the tool body in the well bore. Sand control media such as a gravel pack is disposed in the well annulus circumferentially about the tool body using a dump bailer. The use of radially extending members allow the tool body to pass through restricted diameter openings such as in production tubing, fittings, nipples, pressure control device, packers, valves and the like.

18 Claims, 6 Drawing Sheets

METHOD FOR PLACING A GRAVEL PACK IN AN OIL WELL WITH AN ELECTRIC WIRELINE

BACKGROUND OF THE INVENTION

1. Field of the Invention

The present invention relates to oil well downhole tools and more particularly relates to an improved method for placing a sand control media such as a gravel pack, in a through tubing situation where restrictions need to be passed, wherein collapsible stand off devices are used for creating an annulus between the tool and the internal wall of the casing where sand control media can reside and wherein the stand off devices collapse so that the tool hub can pass through restricted diameters such as production tubing, nipples, pressure control devices, packer bores, valves and the like.

2. General Background

Sand control is required in many oil and gas wells wherein sand enters the wellbore during well production. The sand then flows into the well annulus with the flowing oil and sand creating an abrasive problem. One of the methods of controlling such a problem is through the use of a gravel pack, which is simply a gravel filled portion of the wellbore that serves as a filter mass preventing sand from being carried by produced fluids into the well strainer or perforated liner thus producing mechanical abrasive action that destroys downhole metal parts of the well.

Other problems that relate to sand production include "sanding up" of the wellbore which can eliminate production from perforations below the top of the sand. Sand bridging can occur in the casing or tubing and this shuts off all flow from the perforations. Further, the erosion of sand from surrounding formation can cause damage to the casing because of this loss of formation support. Similarly, casing damage can result from subsidence. Further, sand production creates abrasion at the surface in hydrocarbon processing equipment that is positioned at the well head.

Many patients have been issued relating to methods and apparatus for installing gravel packs. Other patents relate to the discharging of material such as sand or cement in the well. An early patent entitled "Method of Graveling Wells" is U.S. Pat. No. 2,452,654 issued to Hayes. In the Hayes patent, a method of gravel packing a well includes the placing of a granular material in that portion of the well bore within the producing formation and shooting bullets from within the well bore through the granular material into the formation, the suction back of the bullets causing some of the granular material to be pulled into the tubular spaces in back of the bullets. Another early patent that relates to setting a gravel pack in a well is the Baker U.S. Pat. No. 2,707,998 entitled "Setting Tool, Dump Bailer and Well Packer Apparatus".

Another early patent relating to the discharging of a control media into a well is discussed in the Fultz U.S. Pat. No. 2,526,021 entitled "Apparatus For Discharging Viscous Liquids In A Well". The Fultz patent shows a device known as a dump bailer for dumping material into a well and includes a tubular body adapted to be lowered into the well, a frangible seal closing the lower end of the tubular body, a rod passing through the lower portion of the tubular body below the seal and movable therein, the rod being in position to move upwardly to break the frangible seal upon contact of the rod with the bottom of the well, and a piston is disposed within the tubular body above the viscous liquid in the body, and a latch on the body initially holds the piston stationary in the upper end of the tubular body and the latch can be released from the piston after the tubular body reaches the bottom of the well.

U.S. Pat. No. 2,696,258 issued to H. M. Green entitled "Oil Well Cementing Packer" provides a vertically elongated container for depositing cement in a zone within a well bore and features a gas generating charge adapted upon ignition to displace through a lower outlet in the container and into the zone. Another patent that relates to the completion of wells and the use of gravel is U.S Pat. No. 2,635,595 entitled "Well Completion" wherein gravel or other material of desired particle sizes placed between the producing formation and a screen member in such a way that oil or other fluid produced passes through the gravel and into the screen member. A positive means is provided for avoiding the existence of unfilled cavities in the gravel packed section into which the gravel may move such as, the space resulting from bridging of gravel or because the gravel is deposited by the circulation method. In the Greene U.S. Pat. No. 2,696,259 entitled "Apparatus For Firing Propellant Charges In a Well", there is provided a means for depositing cement in a well bore.

The controlling of sand in wells has been the subject of several patents. The Abendroth U.S. Pat. No. 2,775,303 entitled "A Method For Controlling Sand and Wells", provides a method for setting gravel packs suitable for use in wells in which a tubing string is arranged. In the Killingsworth U.S. Pat. No. 2,896,714 entitled "Gravel Packing of Wells", there is shown an improvement for obtaining a gravel pack around a screen pipe or perforated liner in an oil well, the gravel pack completely filling an enlarged cavity around the perforated liner or screen pipe. As part of the method, a bailer is run into the well on a wireline and enters the interior of the liner. The liner is prevented from rotating by means of the frictional resistance offered by the gravel and the centering bow springs and centralizers. Another patent issued to Greene entitled "Apparatus For Depositing Cement or Like in a Well" describes a tool assembly to be lowered into a well on a flexible line and includes a container having a mass of material therein and an opening at the lower portion of the container for dispensing the material such as cement into the well.

The Jones U.S. Pat. No. 3,428,128 entitled "Method and Apparatus For Use in Gravel Packing Wells" provides a method wherein a gas previous basket is lowered into a producing zone, the basket having a plurality of compressed staves. Gravel is placed in the area beneath the basket adjacent the producing zone. The staves are released from the basket so that the staves assume a position in contact with the casing at points substantially around the periphery of the casing, the base of the tasket being located above the points and the well is produced whereby the fluids flow from the producing zone through the gravel into the production conduit, the gravel being retained in position adjacent the producing zone by the basket while entrapped gases in the formation may be passed upwardly through the basket.

The Burrows U.S. Pat. No. 4,635,725 entitled "Method and Apparatus For Gravel Packing a Well" provides a perforated liner in a well that includes a wash pipe carried by a cross-over tool which has a pair of fluid passages through it. Flow of fluid may be reversed. The wash pipe is mounted in a floating relation with the liner for vertical movement and a double acting piston mounted between the liner and washpipe which is responsive to fluid pressure within the liner for moving the washpipe vertically relative to the liner.

U.S Pat. No. 4,618,163 entitled "Sand Control System" provides a well bore sand control and filtration system, method and apparatus for controlling formation sands and for preventing the influx of formation sands into the well bore, into the production string and into the produced fluids. The system includes introducing smooth particles in the well bore with limited or no pumping either of particles or of fluids with the particles, introducing the production string into the wellbore with the bottom of the string being introduced into the accumulation of smooth particles and the bottom of the string having connected thereto a tool permitting flow of formation fluids into the production string. The tool moves into the accumulation of particles forcing particles into the perforation tunnels extending from the annulus through the casing and cement into the formation. The system method and apparatus may also be used in an open, uncased, uncemented hole.

A well screen filter formed with inner and outer concentric screens defining an annular filtering space filled with filtrating medium is the subject of U.S. Pat. No. 4,693,318 entitled "Sand Control Devices and Method of Installation Thereof" issued to Petrovich. A gravel packing apparatus and method is the subject of U.S. Pat. No. 4,700,777 entitled "Gravel Packing Apparatus and Method", issued to Luers. The apparatus provided in the '777 patent is for placing a screen filter in for packing gravel around the filter screen adjacent a well formation. The apparatus includes a body having a packer portion and a valve portion. The body defines a central passageway therethrough. The valve portion includes a valve mandrel with a valve sleeve slideably positioned therein, and transverse openings in the valve sleeve and valve mandrel are aligned to form a transverse passageway therethrough when the valve is in an open position. A stinger is positionable in the body for closing the central passageway and actuating the valve sleeve between the open and closed positions thereof. When in the open position, the transverse openings in the valve mandrel and valve sleeve are aligned with a transverse opening in the stinger such that fluid communication is provided between a well annulus below the packer portion and the tool string above the apparatus. Fingers engage the stinger so that when the stinger is moved from the body, the valve is closed. The stinger has seal members thereon, and the stinger may be positioned such that the transverse opening therein is above the packer portion while at least one seal element is still sealingly engaged with the central passageway. In this way, fluid communication is provided between the tool string and a well annulus above the packer. When the stinger is removed from the body, the central passageway is opened for production of fluids therethrough. A method for using the apparatus is also disclosed.

SUMMARY OF THE PRESENT INVENTION

The present invention provides an improvement to the method of installing a gravel pack in a well bore. The present invention provides an improved method wherein a gravel pack or like sand control device can be installed with an electric wireline, braided line or slick line in a through tubing situation. Thus, a feature of the present invention is the collapsible spring loaded centering devices that can be used for creating an annular gap between the tool and the internal wall of the casing where sand control media can reside. The stand off devices are fully and automatically collapsible so that as the tool is run in the well, the tool can pass through restricted diameters such as production tubing, nipples, pressure control devices, packer bores, valves and the like. The top of the tool has a flow tube atop the screens with a cap that allows lowering via wireline, then after placement, the cap can be removed so that hydrocarbons can flow to the surface.

The present invention further provides an improvement in that multiple tool assemblies can be stacked, therefore the method and apparatus of the present invention are not limited by the particular gravel pack interval of one tool. The present invention provides a method and an apparatus which allows a first lowermost tool assembly to be run in the hole and set in place. A pressure sealing packer assembly can then be set and installed at the bottom of the first tool assembly. Thereafter, a second complete tool assembly can be set in place, joined to the first tool assembly. In cases where the reservoir is being depleted, or has been substantially depleted, the present invention provides a system that allows sand control equipment to be placed in the well after completing of a well and without a need for rig type operations in order to control the sand. This is particularly advantageous because many wells will not produce sand until the formation is substantially depleted. In these cases, remedial work using a complete rig is not economically viable. The present invention allows sand control equipment to be installed as aforementioned with an electric wireline, braided line or slick line without the need for a complete oil drilling rig.

The present invention also allows easy on site assembly and modification of a tool string because of the use of connections between the various sub-portions of the tool assembly. Thus, the present invention provides a method and an apparatus for installing sand control devices in a well, even where the formation has already been substantially depleted, in an economical fashion which does not require a complete drilling rig and with the capability of on site assembly and modification.

The present invention thus provides an improved method for installing sand control in a well having a casing traversing a producing formation and having a tubing string arranged in the casing, terminating at an open end at a point above the bottom of the casing. A packer or isolation device can be used if desired to isolate a production zone from the annular space between the casing and production tubing.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
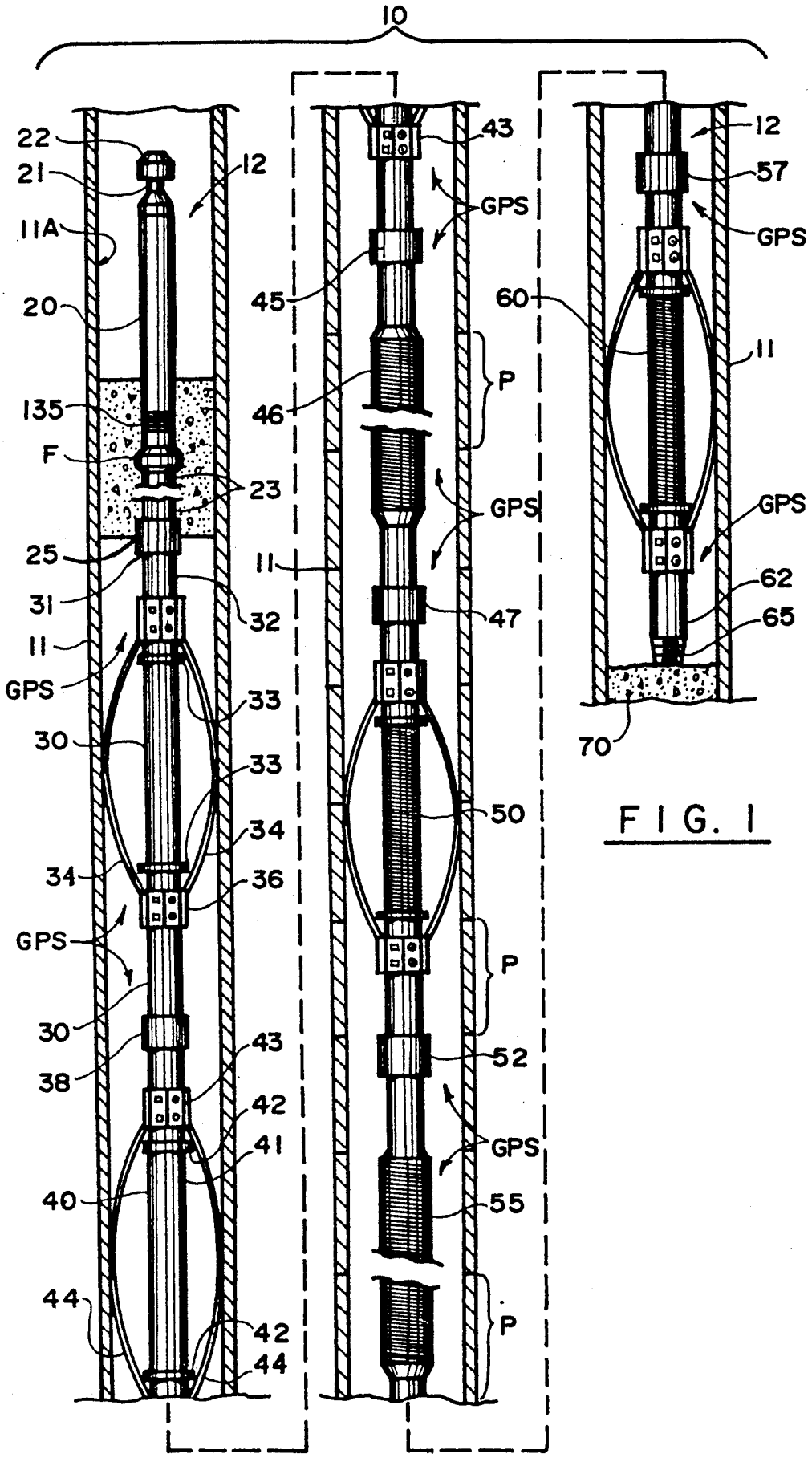
FIG. 1 is a sectional elevational view of the preferred embodiment of the apparatus of the present invention.
Figure 1A:
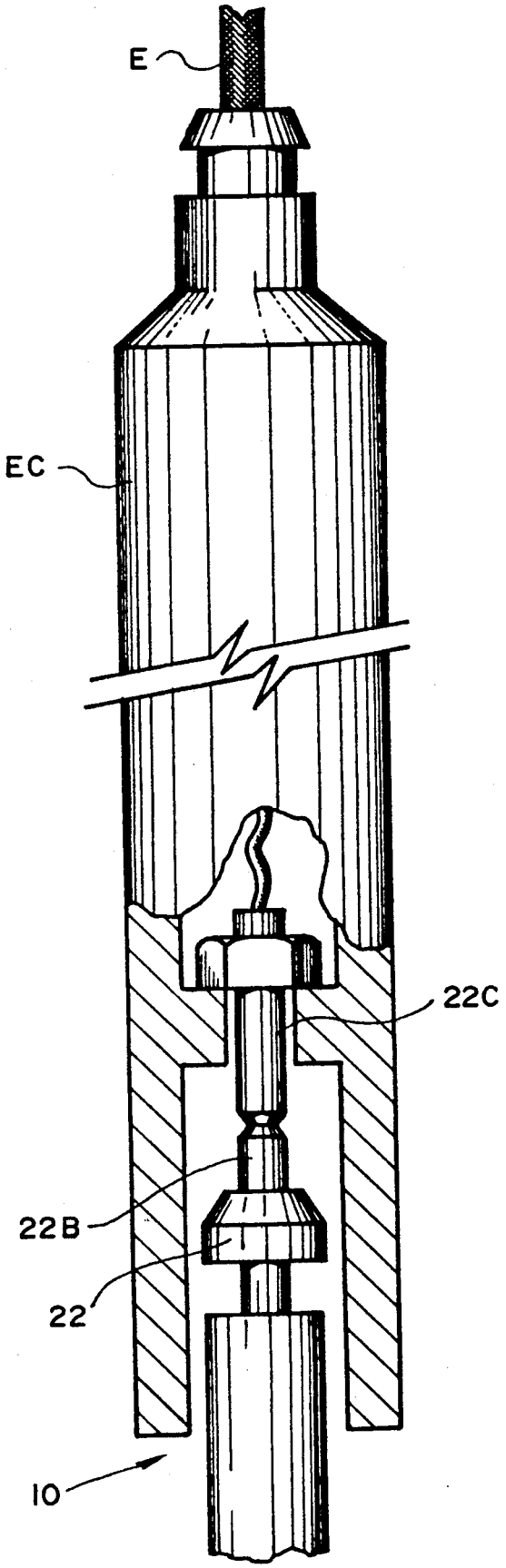
FIG. 1A is an extended sectional view of the preferred embodiment of the apparatus of the present invention illustrating a connection between the electric line and the tool body.
Figure 4:
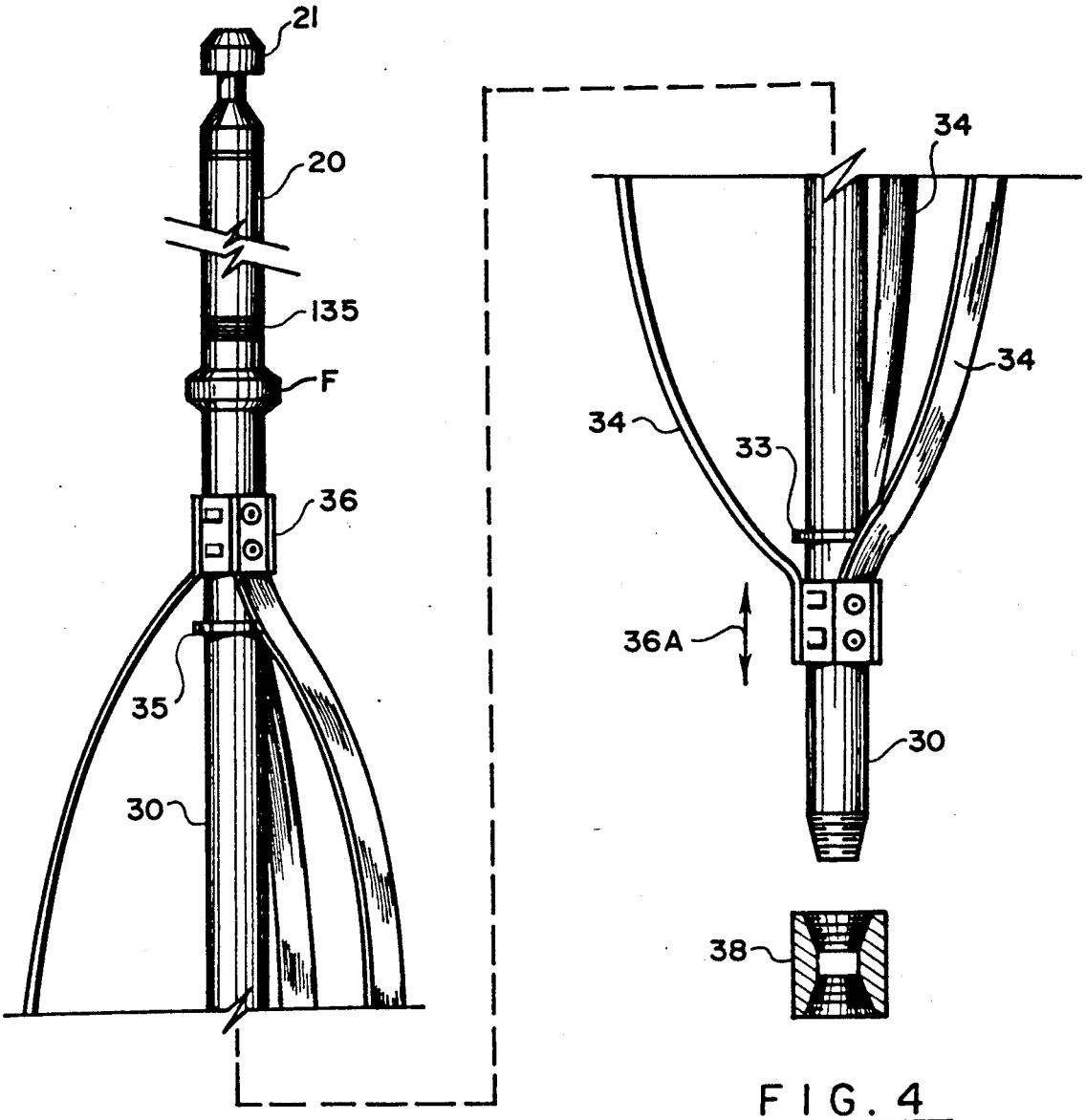
FIG. 4–4A are elevational views of another section of the preferred embodiment of the apparatus of the present invention.
Figure 5:
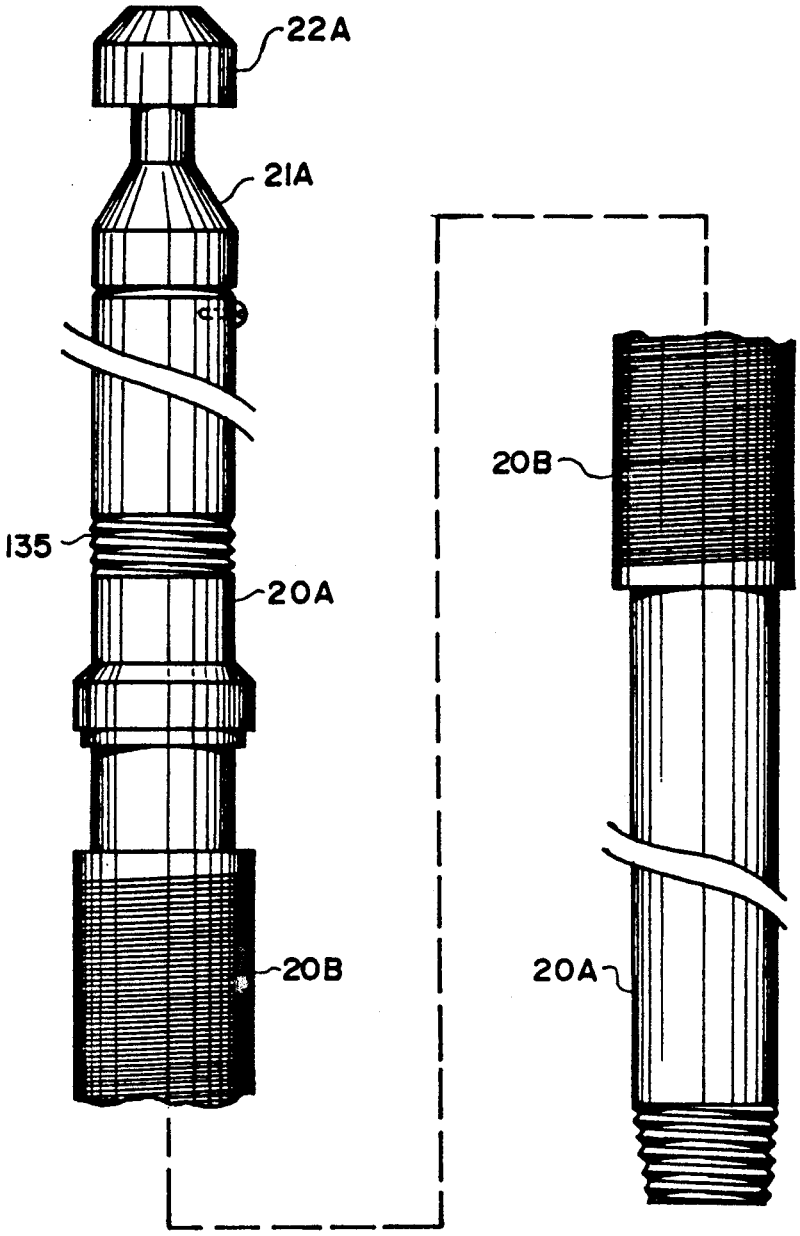
FIG. 5 is an elevational view of the upper section of the preferred embodiment of the apparatus of the present invention.
Figure 6:
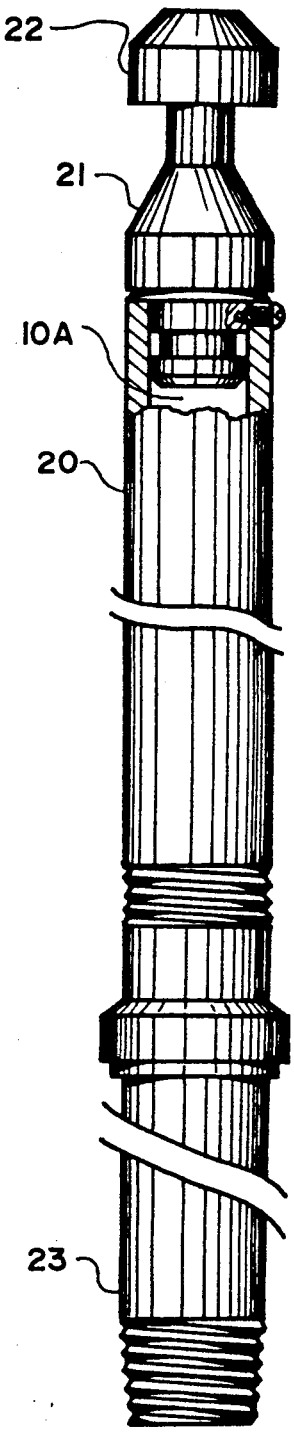
FIG. 6 is a sectional elevational view of the top section of the preferred embodiment of the apparatus of the present invention.

FIGS. 1, 1A, and 2–6 show generally the preferred embodiment of the apparatus of the present invention designated generally by the numeral 10. In FIG. 1, there can be seen in an elevation, elongated section of casing 11 having an internal well annulus 12 through which the tool 10 is run. The tool 10 has a longitudinal continuous flow bore 10A between its end portions. The uppermost end portion of the tool 10 includes a top flow tube segment 20 having an internal longitudinal flow bore. The top flow tube segment 20 is shown in FIG. 6 in greater detail. The uppermost end portion 21 of top flow tube segment 20 features a removable pressure sealing plug 22 that allows the tool 10 to be deployed in the casing within an electric wireline, slick line, braided line or the like (FIG. 1A). The plug is removable so that the bore 10A (FIG. 6) can be opened, allowing formation fluids to flow through a gravel pack medium, such as gravel pack sand GPS into the gravel pack screen 46, 55 and up through the tool bore 10A to the pre-existing completed well.

In FIG. 1A, the electric wireline E is shown connected to an electric wireline carrier EC which is commercially available. The carrier EC provides an electrical firing mechanism 22C which detonates explosive tension bolt 22B that forms a securing connection with the tool string 10 at plug 22. Thus, the illustration of FIG. 1A shows the tool 10 supported by the electric wireline E as the tool 10 is being run in the hole.

The tube segment 20 can carry a series 135 of vertically spaced annular ribs so that the tool 10 can be removed with an overshot 130 having guide 132 and grapple 133 (FIG. 3) that can engage and grip tubular member 20 at the series 135 of annular ribs. A seal 131 can be provided at the upper end of overshot 130.

The lower end 23 of top flow tube segment 20 forms a threaded connection with threaded coupling 25. Coupling 25 then attaches at its lower end to centralized flow tube segment 30 at connection 31. The centralized flow tube segment 30 includes an elongated generally cylindrical body 32 having a longitudinal flow bore that communicates with the flow bore of top flow tube segment 20 so that fluid can flow freely between tube segment 20 and centralized flow tube segment 30. A pair of spaced apart annular stops 33 are disposed inside a plurality stand off devices such as of bow spring centralizers 34 which are spaced circumferentially about the cylindrical body 32. Hubs 36 can slide longitudinally away from stops 33 allowing the bow springs 34 to collapse adjacent cylindrical body 32 and pass through restrictions, valves, fittings, production tubing and the like. In the casing 11 however, the springs 34 expand as shown in FIG. 1 to engage the inside wall 11A of the casing 11 and thus centralize the entire tool assembly 10. One or more fishing necks F can be disposed along the assembled tool 10 so that an overshot can be used to retrieve the tool 10. F and 22 are preferably magnetic markers for precise depth correlation using e.g. a casing collar locator to identify the position of each of these magnetic markers.

A threaded coupling 38 forms a connection between centralized flow tube segment 30 and centralized flow tube segment 40 which are substantially identical in construction. Centralized flow tube segment 40 provides a cylindrical tubular body 41 having a central longitudinal flow bore section that communicates with the flow bore section of centralized flow tube segment 30. These flow bore sections define portions of an overall, uninterrupted tool flow bore 10A.

A pair of stops 42 limit the movement of hubs 43, but the bow springs 44 can collapse toward the tubular section 41 as was the case with respect to the bow springs 34 of centralized flow tube segment 30. The stops 42 assist in supporting one end of the bow springs 44 during reentry to any restricted area, as occurs if the tool 10 is pulled back toward the surface. Threaded coupling 45 defines a connection between centralized flow tube segment 40 and screen segment 46 which allows fluid to flow between the annulus 11 and the longitudinally extending flow bore of 10A of the tool 10. The casing 11 is perforated so that oil can enter annulus 12.

Threaded coupling 47 forms a connection between screen segment 46 and centralized flow tube segment 50 which is identical in construction and function to the centralized flow tube segments 30, 40. Screen segment 55, which is identical in construction and operation to the screen segment 46 is attached to centralized flow tube segment 50 at threaded coupling 52. A lowermost centralized flow tube segment 60, which is identical in construction to the centralized flow tube segments 30, 40, 50 is attached to lowermost screen 55 at threaded coupling 57.

Figure 2:
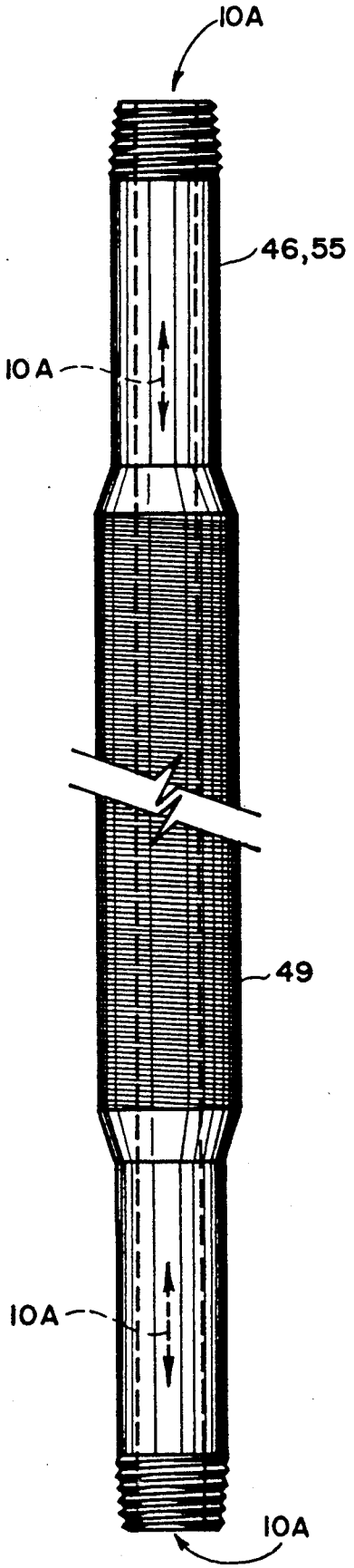
FIG. 2 is an elevational view of a section of the preferred embodiment of the apparatus of the present invention.
Figure 3:
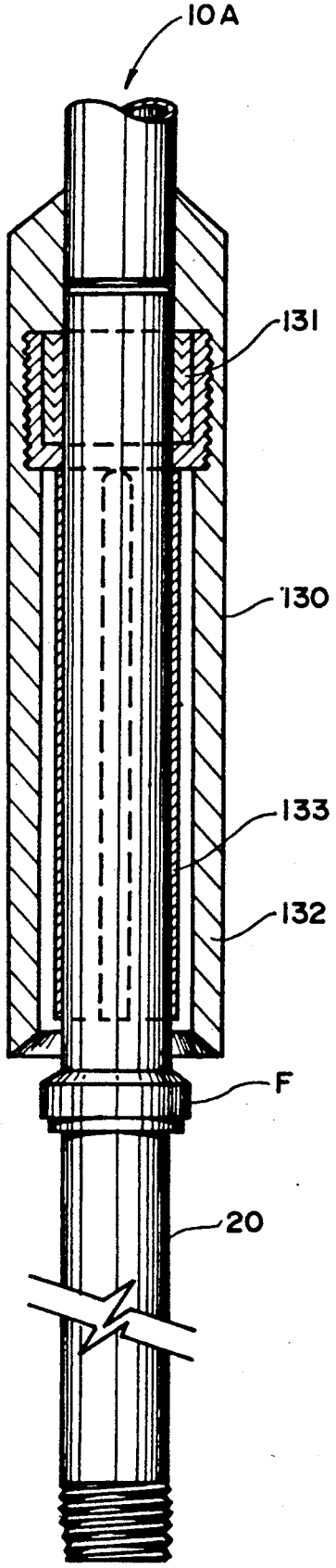
FIG. 3 is an elevational sectional view of a section of the preferred embodiment of the apparatus of the present invention illustrating the overshot/packoff assembly used in extended length gravel pack installations.

The lowermost end portion of tool 10, designated by the numeral 62 is closed with pipe plug 65. In the preferred embodiment a cement plug 70 is placed under tool 10 for the purposes of retaining the gravel pack or other sand control media. Sand control media is disposed above cement plug 70 and in the well annulus 12 using a dump bailer and to a level that extends above the perforations P in the casing. FIG. 2 illustrates more particularly the construction of screen segments 46, 55 having a generally cylindrical, elongated construction with a central longitudinal flow bore 10A which communicates with the continuous flow bore of the tool body, designated as 10A.

Figure 4A:
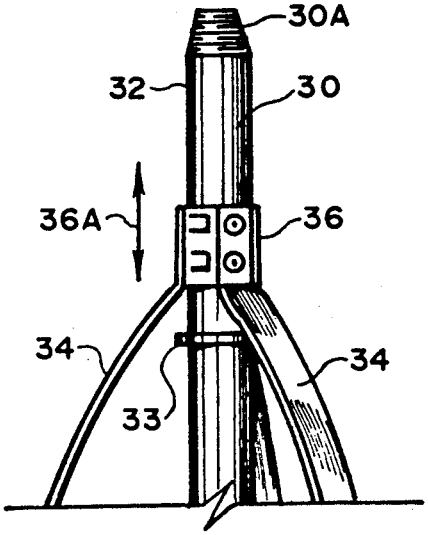

The central portion of screen element 46 of each screen element 46, 55 provides well screen section 49. FIGS. 4–4A illustrate the multiple flow tube segments 30, 40, 50, 60 which are of identical construction. In FIGS. 4 and 4A, the hubs 36 are illustrated and the connected bow springs 34. Hubs 36 slide longitudinally along tubular body 32 of centralized flow tube segments 30 as illustrated by the arrows 36A in FIGS. 4 and 4A.

The hubs 36 are spaced sufficiently from the threaded end portions 30A of tubular body 32 so that the hubs can move far enough to substantially collapse the springs. The stops 33 support the springs to assure reentry. This construction allows the entire tool 10 to be centralized within the annulus 12 at all times yet allows a complete collapsing of the springs 34 when the tool must pass through restrictions such as valves, production tubing, nipples, and the like. FIG. 5 shows an alternate construction of the top flow tube segment designated by the numeral 20A. In FIG. 5, the top flow tube segment 20A includes an upper end 21A having a fishing neck 22A. However, the top flow tube segment 20A includes an optional screen segment 20B.

FIG. 6 illustrates top flow tube segment 20 of the preferred embodiment illustrating the upper end portion 21 of the top flow tube segment 20, the fishing neck 22, the central longitudinal flow bore 10A, and the lower end portion 23 which attaches to coupling 25.

Figure 7:
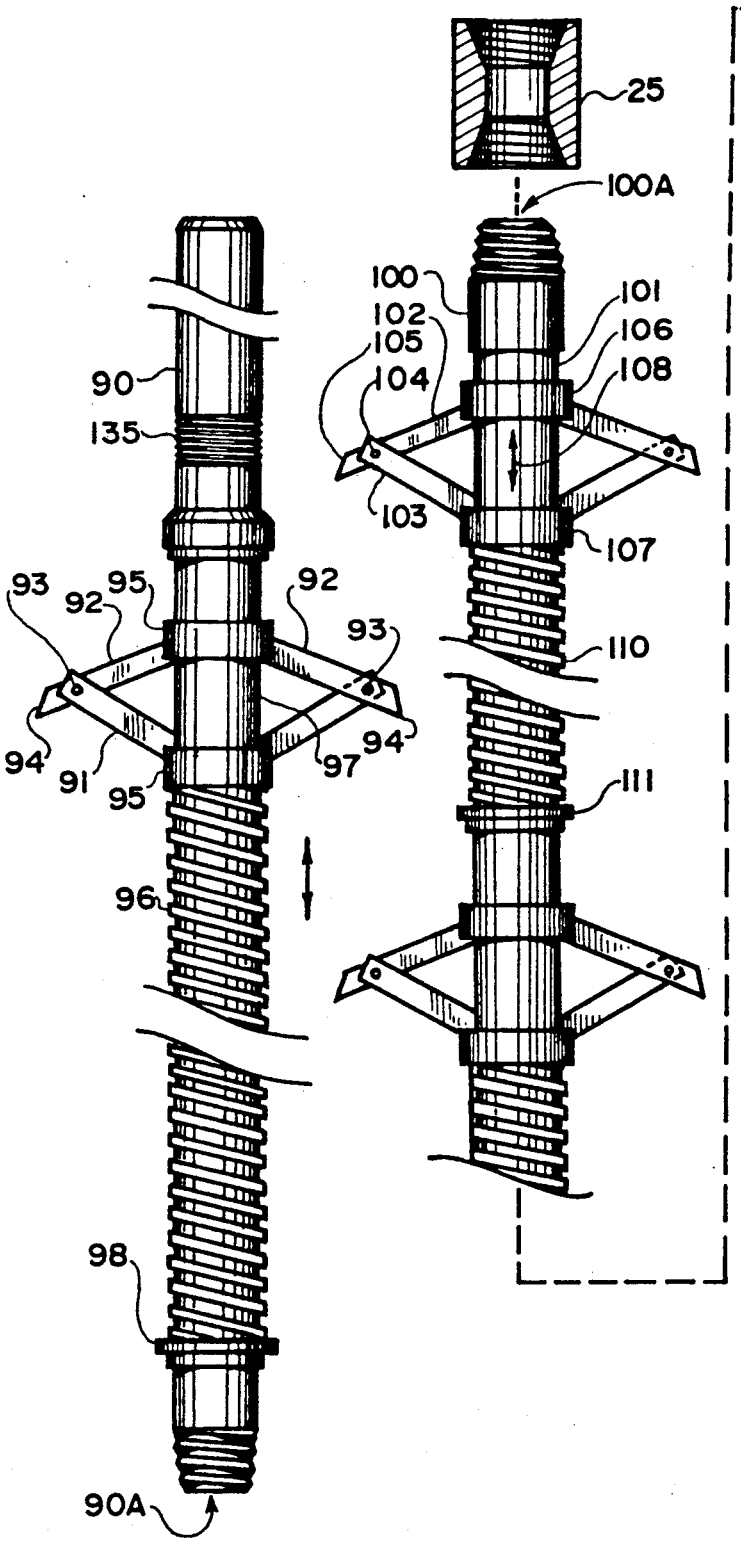
FIG. 7 is a fragmentary elevational view of a second embodiment of apparatus of the present invention.
Figure 8:
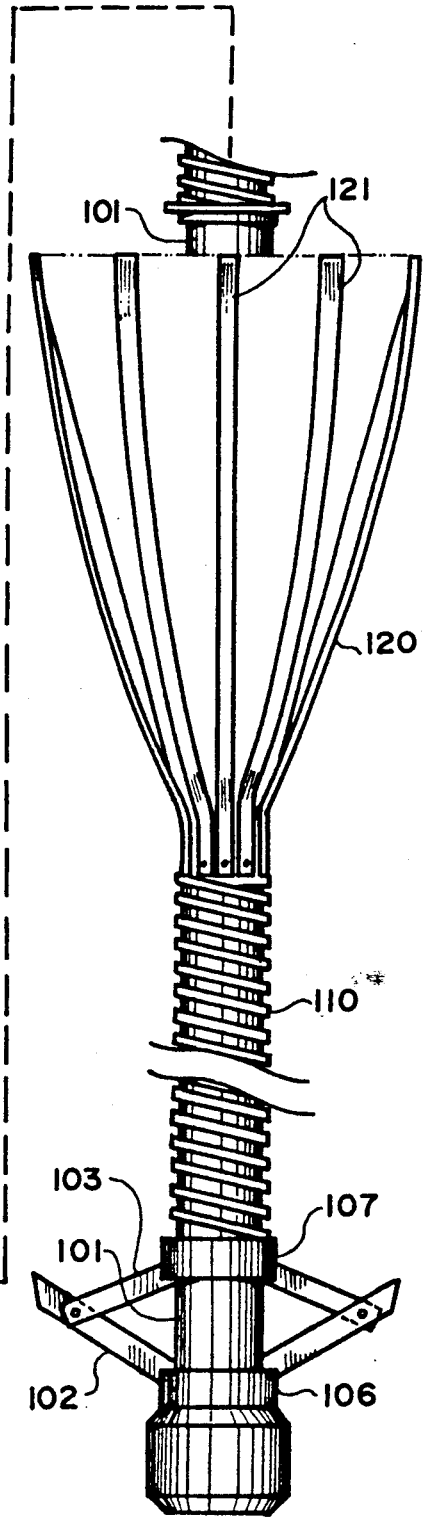
FIG. 8 is a fragmentary elevational view of a third embodiment of the apparatus of the present invention.

FIGS. 7 and 8 illustrate second and third embodiments of the centralized flow tube segments, designated respectively by the numerals 90, 100. In FIG. 7, centralized flow tube segment 90 includes a plurality of circumferentially spaced centralizers in the form of a pair of links 91, 92 pivotally connected at 93, the link 92 being slightly longer providing an outermost case hardened anchor tip 94 that engages and anchors the assembly to the casing inner wall 11A. A pair of spaced apart annular collars 95, 96 slide upon the tube segment body 97 which is generally cylindrical and provides a central longitudinal flow bore 10A. Coil spring 97 extends between hub 95 and stop 98. The coiled spring 96 can collapse allowing the hubs 95, 96 to move apart thus collapsing the links 91, 92 upon the tube body 97 so that the centralized flow tube segment 90 can pass through restrictions as with the preferred embodiment.

In the embodiment of FIG. 8, designated generally by the numeral 100, the centralized flow tube segments 100 include a generally cylindrical body 101 having a central longitudinal flow bore 100A. This embodiment allows screen segments and bow spring centralizers to be run above this assembly (FIG. 7, 8). It has anchors and can be set in place and therefore provide a platform for cement and subsequent sand. Then multiple segments can be stacked atop this anchored segment. A pair of links 102, 103 are pivotally connected at 104 with the link 102 being slightly larger providing an outer anchor tip 105 that engages the inner wall 11A of the casing. Hubs 106, 107 can move apart as illustrated by the arrow 108 in FIG. 8 allowing the links 102, 103 to collapse to a position adjacent the body 101, in which case coil spring 110 is contracted in order to allow the links 102, 103 to fully retract against the body 101. A stop 111 abuts the end portion of coil spring 110 opposite hub 107. With respect to embodiments of FIGS. 7 and 8, the coil spring 96 and 110 respectively load the links to an expanded position so that the links function to centralize the tools 90, 100 within the annulus 12 of the casing 11.

In the embodiment of FIG. 8, a basket 120 is affixed to the lowermost end portion of the tool 100 and includes a plurality of circumferentially spaced fingers 121 that extend outwardly, away from the body 101 and assist in holding gravel or other sand control media so that it does not fall below the basket 120 during use. In the embodiment of FIG. 8, centralizing links 102, 103 are also provided below the basket 120. The links 102, 103 are pivotally attached to hubs 106, 107 so that they can pivot with resect to the hubs 106, 107 during a collapsing of the links 102, 103 upon the tube body 101.

The present invention provides a method and apparatus for installing gravel packs or like sand control media in a through tubing situation via electric line deployment, or through the use of a slick line or braided line. The apparatus 10 can be run in the hole in multiple segments via multiple electric line runs if desired. Indeed, an entire second assembly 10 can be placed above the first assembly by removing the neck 22 with an overshot pulling device, shearing the shear pin (FIG. 6). Then the new assembly 10 is added to the first assembly 10 using the connection shown in FIG. 3.

Precise positioning relative to the formation and or the casing 11 can be accomplished via gamma ray or casing collar locator electric line tools. One or more magnetic fishing necks F can be provided so that the tool 10 or sections car be retrieved thereof using the electric wireline if problems arise. The embodiment of FIG. 8 allows the tool 10 to be deployed in the casing with no platform below. The embodiment of FIG. 8 thus provides the bottom of the tool 10 with spring loaded linkages 102, 103 which centralize and anchor the tool. The lowermost section of the tool includes a basket 120 for retaining the gravel pack in position. The lowermost section of this embodiment must be run in the hole in an encasement. However subsequent sections do not require the encasement.

Optionally, fluid can be pumped from the surface which will enhance uniform setting of the gravel pack sand and elimination cf void formation. In the method of the present invention, the gravel pack sand can be placed via a dump bailer for example. The gravel pack sand can be run with or without a suspension agent.

Once the gravel pack screen and sand are in place, cement can be optionally placed atop the gravel pack to permanently retain the gravel packed sand. This allows the installation of a very short downhole tool string. An extended length of gravel pack sand can be dumped above the top of the screen. Optionally this extended gravel pack cap can be capped with a low strength gelatinous material for example, which will resist or eliminate initiation of flow vertically. In the method of the present invention, a method is thus provided for setting a gravel pack in an oil well through tubing situation. The method includes the running of an elongated tool body 10 into the well via an electric wireline deployment. A slick line or braided line can also be used. The tool body 10 is then precisely positioned relative, to the surrounding formation. The precise position can be located through the use of for example gamma ray or casing collar locator electric line tools. Regularly extending members 30, 40, 50, 60, 90, 100 that extend from the tool body 10 are then used to center the tool body 10 within the well bore. Thereafter, sand control media is disposed in the well annulus circumferentially about the tool body using a dump bailer for example. The method as above described allows the tool body to pass through one or more areas of restricted diameter during which the tool body can collapse to a minimum diameter at the restricted diameter areas. This allows the tool body 10 to pass through restricted diameter areas such as production tubing, fittings, valves and the like.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A method for installing a sand control device in an oil/gas well comprising the steps of:
   a) running a plurality of stackable tool bodies into the well, each via electrical wireline deployment;
   b) positioning each tool body in a desired location relative to the surrounding formation and in flow communication with each so that hydrocarbons can be produced, flowing internally from one tool body to the others;
   c) using radially extending members that extend from each tool body to generally center the respective tool body in the well bore providing an annulus about the tool body; and
   d) disposing sand control media in the well annulus circumferentially about the assembly of the tool bodies.

2. The method of claim 1 wherein the wireline is a braided line.

3. The method of claim 1 wherein the wireline is a slick line.

4. The method of claim 1 wherein in step "b" the tool bodies are positioned using a casing collar locator.

5. The method of claim 1 wherein the sand control media is a gravel pack material.

6. The method of claim 1 wherein the tool bodies pass through one or more areas of restricted diameter and in step "c" the radially extending members collapse at the restricted diameter areas.

7. The method of claim 6 wherein in step "c" the restricted diameter area is a section of production tubing.

8. The method of claim 6 wherein in step "c" the restricted diameter area is a fitting.

9. The method of claim 6 wherein in step "c" the restricted diameter area is a valve.

10. The method of claim 1 further comprising the step "e" of using the lower end portion of the tool assembly to retain the sand control media at a desired elevation in the well.

11. The method of claim 1 further comprising the step of pumping fluid from the wellhead surface area in order to enhance uniform settling of the gravel pack.

12. The method of claim 11 wherein the fluid includes a suspension agent.

13. A method for installing a sand control device in an oil/gas well comprising the steps of:
   a) running a plurality of stackable tool bodies into the well, each via wireline deployment;
   b) positioning each tool body in a desired location relative to the surrounding formation and in flow communication with each so that hydrocarbons can be produced, flowing internally from one tool body to the others;
   c) using radially extending members that extend from each tool body to generally center the respective tool body in the well bore providing an annulus about the tool body; and
   d) disposing sand control media in the well annulus circumferentially about the assembly of the tool bodies,
   e) wherein the tool body is positioned using gamma rays.

14. A method for installing a sand control device in an oil/gas well comprising the steps of:
   a) running a plurality of stackable tool bodies into the well, each via wireline deployment;
   b) positioning each tool body in a desired location relative to the surrounding formation and in flow communication with each so that hydrocarbons can be produced, flowing internally from one tool body to the others;
   c) using radially extending members that extend from each tool body to generally center the respective tool body in the well bore providing an annulus about the tool body; and
   d) disposing sand control media in the well annulus circumferentially about the assembly of the tool bodies,
   e) wherein the tool assembly has a common longitudinal through bore and a sealing medium is placed above and below the sand control media.

15. A method for installing a sand control device in an oil/gas well comprising the steps of:
   a) running a plurality of stackable tool bodies into the well, each via wireline deployment;
   b) positioning each tool body in a desired location relative to the surrounding formation and in flow communication with each so that hydrocarbons can be produced, flowing from one tool body to the others;
   c) using radially extending members that extend from each tool body to generally center the respective tool body in the well bore providing an annulus about the tool body; and
   d) disposing sand control media in the well annulus circumferentially about the assembly of the tool bodies,
   e) wherein in step "d" the sand control media is disposed in the annular gap between the tool and formation using a dump bailer.

16. A method for installing a sand control device in an oil/gas well comprising the steps of:
   a) running a plurality of stackable tool bodies into the well, each via wireline deployment;
   b) positioning each tool body in a desired location relative to the surrounding formation and in flow communication with each so that hydrocarbons can be produced, flowing internally from one tool body to the others;
   c) using radially extending members that extend from each tool body to generally center the respective tool body in the well bore providing an annulus about the tool body; and
   d) disposing sand control media in the well annulus circumferentially about the assembly of the tool bodies,
   e) placing a sealing medium above the sand control media.

17. The method of claim 16, wherein the step "e" the sealing medium is placed above and below the sand control media.

18. A method for installing a sand control device in an oil/gas well through tubing situation comprising the steps of:
   a) running a plurality of stackable tool bodies into the well, each via wireline deployment;
   b) positioning each tool body in a desired location relative to the surrounding formation and in flow communication with each so that hydrocarbons can be produced, flowing from one tool body to the others;
   c) using radially extending members that extend from each tool body to generally center the respective tool body in the well bore providing an annular gap about the tool body; and
   d) disposing sand control media in the well annulus circumferentially about the assembly of the tool bodies, and without circulation of the sand control media from the surface via a flow bore.

* * * * *